US005078916A

United States Patent [19]

Kok et al.

[11] Patent Number: 5,078,916

[45] Date of Patent: Jan. 7, 1992

[54] DETERGENT COMPOSITION CONTAINING AN INTERNAL OLEFIN SULFONATE COMPONENT HAVING AN ENHANCED CONTENT OF BETA-HYDROXY ALKANE SULFONATE COMPOUNDS

[75] Inventors: Riekert Kok; Hendrikus H. Deuling; Theodorus A. B. M. Bolsman, all of Amsterdam, Netherlands

[73] Assignee: Shell Oil Company, Houston, Tex.

[21] Appl. No.: 682,173

[22] Filed: Apr. 9, 1991

Related U.S. Application Data

[63] Continuation-in-part of Ser. No. 460,426, Jan. 3, 1990, abandoned.

[30] Foreign Application Priority Data

Jan. 3, 1989 [GB] United Kingdom ..... 8900023

[51] Int. Cl.[5] ..... C11D 1/12; C11D 1/755

[52] U.S. Cl. ..... 252/549; 252/8.554; 252/353; 252/533; 252/536; 252/555

[58] Field of Search ..... 252/549, 555, 536, 533, 252/353, 8.554

[56] References Cited

U.S. PATENT DOCUMENTS

| | | | |
|---|---|---|---|
| 3,332,874 | 7/1967 | Coward et al. | 252/137 |
| 3,332,880 | 7/1967 | Kessler et al. | 252/161 |
| 3,346,629 | 10/1967 | Broussalian | 260/513 |
| 3,444,087 | 5/1969 | Eccles et al. | 252/138 |
| 3,708,437 | 1/1973 | Sweeney | 252/555 |
| 3,896,057 | 7/1975 | Lindsay et al. | 252/555 |
| 4,507,223 | 3/1985 | Tano et al. | 252/353 |

FOREIGN PATENT DOCUMENTS 1217137 12/1970 United Kingdom .

OTHER PUBLICATIONS

Roberts et al, Tenside Detergents, 22 (9) (1985), 193–195.

*Primary Examiner*—A. Lionel Clingman
*Assistant Examiner*—William S. Parks

[57] ABSTRACT

The invention relates to a detergent composition comprising an internal olefin sulfonate salt having from 8 to 26 carbon atoms, wherein at least 25% by weight of the internal olfein sulfonate salt is in the beta-hydroxy alkane sulfonate form. It has been found that internal olefin sulfonate salts having enhanced beta-hydroxy alkane sulfonate content provide excellent detergency.

13 Claims, No Drawings

DETERGENT COMPOSITION CONTAINING AN INTERNAL OLEFIN SULFONATE COMPONENT HAVING AN ENHANCED CONTENT OF BETA-HYDROXY ALKANE SULFONATE COMPOUNDS

This is a continuation-in-part of application Ser. No. 07/460,426, filed Jan. 3, 1990.

FIELD OF THE INVENTION

The invention relates to a detergent composition comprising an internal olefin sulfonate salt, e.g., an alkali metal, alkaline earth metal or ammonium salt or a salt of an organic base, having from 8 to 26 carbon atoms. More particularly, the invention relates to a detergcnt composition comprising such a sulfonate salt component at least 25% by weight of which is in beta-hydroxy alkane sulfonate form.

BACKGROUND OF THE INVENTION

The products of the sulfonation of internal olefins, i.e. olefins having a double bond on a position different from the alpha-position, followed by neutralization and hydrolysis are commonly referred to as internal olefin sulfonates. It is known that internal olefin sulfonates are mixtures of alkene sulfonates, hydroxy alkane sulfonates and optionally disulfonates. In this respect reference is made to U.S. Pat. No. 4,507,223, which is hereby incorporated by reference.

From Roberts et al, Tenside Detergents, 22 (4) (1985) 193–195, it is known that the hydroxy alkane sulfonates can be beta-, gamma- and delta-hydroxy alkane sulfonates.

The commonly-assigned copending patent application Ser. No. 382,506, filed July 20, 1989, describes and claims a process for the preparation of internal olefin sulfonates by reacting in a film reactor one or more internal olefins having from about 8 to 26 carbon atoms with a gaseous sulfonating agent in a mol ratio of sulfonating agent to internal olefins in the range from about 1:1 to 1.25:1, while cooling the reactor with a cooling means having a temperature not exceeding 35° C., and neutralizing and hydrolyzing the resulting sulfonic acids. The product sulfonate salts have a high content of beta-hydroxy compounds.

Internal olefin sulfonate salts having low contents of beta-hydroxy compounds are known, and are disclosed in the prior art, particularly in published United Kingdom patent specification 1,217 137, for use as components of detergent compositions.

SUMMARY OF THE INVENTION

It has now been found that the internal olefin sulfonates with a high percentage of beta-hydroxy compounds exhibit excellent performance in detergent compositions.

The invention therefore relates to a detergent composition comprising a internal olefin sulfonate salt having from 8 to 26 carbon atoms, wherein at least 25% by weight of the internal olefin sulfonate is in the beta-hydroxy alkane sulfonate form. Preferably, between about 50 and 90% by weight of the internal olefin sulfonate component is beta-hydroxy alkane sulfonate, and more preferably between about 60 and 85% by weight of the internal olefin sulfonate is beta-hydroxy alkane sulfonate. In each case, the specified percentage of beta-hydroxy alkane sulfonate is calculated on the basis of the total amount of the sulfonate salt derived from the internal olefin Preference can also be expressed for internal olefin sulfonates containing from about 12 to 20 carbon atoms. The sulfonate salts are products of the neutralization of the corresponding sulfonic acids with one or more bases selected from the group consisting of sodium, potassium, and ammonium bases, and organic bases.

DESCRIPTION OF THE INVENTION

The present invention centers upon detergent compositions which comprise an internal olefin sulfonate component, at least about 25% by weight of which is in the beta-hydroxy alkane sulfonate form. Internal olefin sulfonates having such a content of beta-hydroxy alkane sulfonates and a method for their preparation are disclosed in the aforementioned commonly-assigned, copending patent application Serial No. 07/382,506, filed July 20, 1989. As is explained in the S.N. 382,506 application, conventional sulfonation reactions of internal olefins result first in the formation of beta-sultones, which are in large part then converted to the corresponding gamma-sultones and potentially further to the corresponding delta-sultones. Upon neutralization, the gamma-sultones and delta-sultones are converted to gamma-hydroxy alkane sulfonate salts and delta-hydroxy alkane sulfonate salts respectively. The resulting sulfonate product contains less than about 10 percent by weight of the beta-hydroxy alkane sulfonate compounds.

The process of the S.N. 382,506 provides for the preparation of sulfonate salt products enriched in their content of sulfonate salts in the beta-hydroxy alkane sulfonate form.

The disclosures of the copending application S.N. 382,506 are incorporated herein by this reference thereto.

For purposes of the present invention, internal olefin sulfonates components having a content of beta-hydroxy alkane sulfonate compounds of at least about 25% by weight, are applied in a detergent formulations. In general, compositions of the invention preferably contain at least about 1% by weight of the specified internal olefin sulfonate component. Most common and most useful compositions contain between about 1 and about 40 percent by weight of the specified internal olefin sulfonate component, calculated on the total weight of the composition. Preferred content of the specified internal olefin component is between about 3 and 50 percent by weight, while a content of the internal olefin sulfonate component in the range from about 5 to 30 percent by weight is generally considered most typical.

In addition to the specified internal olefin sulfonate component, the detergent composition according to the invention may comprise at least one other surface active material, particularly at least one other surfactant selected from the group consisting of anionic, nonionic, amphoteric and cationic surfactants Such other surfactants are commonly present in a concentration of at least 1 percent by weight, more preferably in a concentration of between about 1 and 50 percent by weight, calculated on the total weight of the composition. Compositions of the invention typically have a total content of surfactants, including the specified internal olefin sulfonate, in the range from about 5 to 60 percent by weight.

Examples of anionic surfactants are alkylbenzene sulfonates, alkane sulfonates, alpha-olefin sulfonates, ester sulfonates, primary and secondary alkyl sulfates, alkylpolyether sulfates and alkyl polyether carboxylates.

Examples of nonionic surfactants are alcoholethoxylates, alkyphenolethoxylates, polyethylene glycol esters, alkyl polysaccharides and fatty acid mono- and dialkanolamides.

Certain preferred detergent compositions coming within the scope of the invention comprise at least one anionic surfactant from the group consisting of alkyl sulfonates and alkyl sulfates, having from 8 to 18 carbon atoms; alkyl polyether sulfates and alkyl polyether carboxylates, having 10 to 18 carbon atoms in the alkyl group and from 1 to 5 ethoxy groups; alkylbenzene sulfonates, having from 8 to 18 carbon atoms in the alkyl chain; alpha-olefin sulfonates prepared by sulfonation of $C_{12}$–$C_{24}$ alpha-olefins; and sulfonated methyl ester of fatty acids.

Other specifically preferred detergent compositions according to the invention comprise the condensation products of 1 to 12 mol ethylene oxide per mol of one or more active hydrogen containing substrates including $C_8$ to $C_{18}$ alcohols and mono- or dialkyphenols having 6 to 12 carbon atoms in the alkyl chain.

Particularly preferred detergent compositions comprise at least one nonionic surfactant which is selected from polyethylene glycol esters based on $C_{10}$–$C_{18}$ fatty acids with 2 to 12 ethoxy groups; the condensation products of detergent range, i.e., $C_8$ to $C_{18}$, alcohols with ethylene oxide and/or propylene oxide, in which the number of ethoxy groups ranges from 3 to 12 and the ratio ethoxy/propoxy is from 4 to 12; and alcohol ethoxylates in which the hydroxyl hydrogen is replaced by an alkyl group having 1 to 4 carbon atoms or an acetyl group.

The detergent compositions according to the invention may also comprise one or more inorganic or organic detergent builders. Examples of builders are the phosphate, polyphosphate, silicate, sulfate, carbonate and borate salts, particularly alkali metal salts.

The detergent composition according to the invention may also comprise at least one sequestering agent of the group consisting of sodium, potassium and ammonium salts of amino polycarboxylic acids, hydroxy carboxylic acids, polycarboxylic acids, alkyl polycarboxylic acids, aminoalkanepolyphosphonic acids, hydroxyalkanepolyphosphonic acids and alkanepolyphosphonic acids. Preferred is a detergent composition comprising an aluminosilicate, particularly of the zeolite A type.

The detergent compositions according to the invention may comprise a percompound or an active chlorine compound as a bleaching agent. As an example of a percompound mention may be made of sodium perborate tetrahydrate. The composition according to the invention may also contain a peroxy acid generating bleach activator.

The detergent compositions according to the invention may additionally comprise one or more component, as are know to function as greyness preventing agents, soil release polymers, foam control agents, fluorescent whiteners, enzymes or perfumes.

The detergent compositions according to the invention may further contain hydrotropes and/or solubilizer alcohols. Examples of hydrotropes are alkali metal salts of benzene, toluene or xylene sulphonic acid, of formic acid, citric acid or succinic acid, urea, mono-, di- or triethanolamine. Examples of solubilizer alcohols are ethanol, isopropanol, mono- or polyethylene glycol, monopropylene glycol or an etheralcohol.

The internal olefin sulfonate with at least 25% by weight of beta-hydroxy alkane sulfonate may be suitably used in any type of detergent formulation, e.g., granular laundry detergents, liquid laundry detergents, liquid dishwashing detergents and in a number of miscellaneous formulations such as general purpose cleaning agents, liquid soaps, shampoos and liquid scouring agents.

The granular laundry detergents generally comprise a number of other components:

other surfactants of the ionic, nonionic, amphoteric or cationic type,
builders (phosphates, zeolites),
cobuilders (polycarboxylates),
bleaching agents and their activators,
foam controlling agents,
enzymes,
optical brighteners, and
stabilizers.

Liquid laundry detergents generally comprise the same components as granular laundry detergents, but generally contain less of the inorganic builder component. Hydrotropes are often present in the liquid detergent formulations.

General purpose cleaning agents may comprise other surfactants, builders, foam suppressing agents, hydrotropes and solubilizer alcohols.

The surfactant of the present invention can be used in many formulations, designed to clean or to wash various substrates.

Hereinafter follows a further description of the typical components of formulations according to the invention.

Surfactants

The internal olefin sulfonate component, containing at least 25%w of beta-hydroxy alkane sulfonates, can be applied as the sole surface-active detergent component, but can also be used in combination with known other surfactants selected from the class of anionic, ampholytic and cationic surfactants. Suitable anionic surfactants include alkyl sulfonates and sulfates containing from 8 to about 18 carbon atoms; alkylbenzene sulfonates with 8–18 carbon atoms in the alkyl chain, alpha-olefin sulfonates prepared by the sulfonation of $C_{12}$–$C_{24}$ alpha-olefins and sulfonated methylester surfactants.

Particularly useful in liquid dishwashing and foaming agents are alkylether sulfates with 10 to 18 carbon atoms in the alkyl residue and 1–6 ethyleneglycol ether groups.

The anionic surfactants mentioned before are applied in the form of their sodium salts, but also potassium, ammonium, mono-, di-, triethanol amine salts can be used, the latter preferably in liquid formulations.

Nonionic surfactants are particularly useful in combination with the internal olefin sulfonate surfactants, to produce formulations having the desired hydrophylic/-lipophylic balance in the formulation.

Preferred nonionics are the "ethoxylate" condensation products of 1–12 mols of ethylene oxide per mol of detergent range alcohols, such as fatty, oxo and secondary alcohols out of the $C_8$–$C_{18}$ range, or of mono- or dialkyl-substituted phenols containing 6–12 carbon atoms in the alkyl chain(s). In laundry powder formulations and in built laundry liquids the use of ethoxylates representing the addition of an average of 2–5 mols ethylene oxide per mol of alcohol is preferred, while in non-built laundry liquids and in dishwashing liquids preference is given to the product of the addition of an average of 5–9 mols ethylene oxide.

Other useful nonionic surfactants are polyethylene glycol esters based on $C_{12}$–$C_{18}$ fatty acids with an average of 2–10 added ethylene oxide groups; the condensation products of detergent range alcohols with both ethylene- and propylene oxide in which the average number of added ethylene oxide groups ranges from 3–12 and the average molar ratio of added ethylene oxide to added propylene oxide is from about 10:1 to 5:1; and "capped" alcohol ethoxylate derivatives in which the hydroxyl hydrogen is replaced by a short hydrophobe such as methyl, isopropyl, isobutyl or acetyl.

Suitable amphoteric surfactants are detergent range betaines, amidobetaines and sulfobetaines. They are preferably applied as foam stabilizing agents in liquid dishwashing formulations.

Builders

In addition to surfactants, the washing and cleaning agents may also contain known builder salts in amounts up to 90% by weight, preferably between about 5 and 35% by weight, to intensify the cleaning action.

Examples of common inorganic builders are phosphates, polyphosphates, alkali metal carbonates, silicates and sulfates. Examples of organic builders are polycarboxylates, aminocarboxylates such as ethylenediaminotetraacetates, nitrilotriacetates, hydroxycarboxylates, citrates, succinates and substituted and unsubstituted alkanedi- and polycarboxylic acids. Another type of builder, useful in granular laundry and built liquid laundry agents, includes various substantially water-insoluble materials which are capable of reducing the water hardness e.g. by ion exchange processes. In particular the complex sodium aluminosilicates, known as type A zeolites, are very useful for this purpose.

Bleachers

The formulations, designed for textile washing, may also contain percompounds with a bleaching action, such as perborates, percarbonates, persulfates and organic peroxy acids. Formulations containing percompounds may also contain stabilizing agents, such as magnesium silicate, sodium ethylenediaminetetraacetate or sodium salts of phosphonic acids. In addition, bleach activators can be used to increase the efficiency of the inorganic persalts at lower washing temperatures. Particularly useful for this purpose are substituted carboxylic acid amides, e.g., tetraacetylethylenediamine., substituted carboxylic acids, e.g., isononyloxybenzenesulfonate and sodiumcyanamide.

Hydrotropes

Although the beta-hydroxy sulfonates have excellent solubility and viscosity characteristics when applied in liquid formulations, it may be desirable in some formulations to add hydrotropes and/or solubilizer alcohols to control stability and viscosity.

Examples of suitable hydrotropic substances are alkali metal salts of benzene, toluene and xylene sulfonic acids; alkali metal salts of formic acid, citric and succinic acid, alkali metal chlorides, urea, mono-, di-, and triethanolamine. Examples of solubilizer alcohols are ethanol, isopropanol, mono- or polyethylene glycols, monopropylene glycol and etheralcohols.

Other Ingredients

Laundry detergent compositions according to the invention may further contain other ingredients, such as antigreying agents, foam control agents, enzymes, optical brighteners and perfumes. Typically, these other ingredients are applied in relatively minor quantities, e.g., 5%w or less.

As antigreying agents, watersoluble colloids of an organic nature are preferably used. Examples are water soluble polyanionic polymers such as polymers and copolymers of acrylic and maleic acid, cellulose derivatives such as carboxymethyl cellulose methyl- and hydroxyethylcellulose.

Examples of foam control are high molecular weight fatty acid soaps, paraffinic hydrocarbons, and silicon containing defoamers. In particular hydrophobic silica particles are efficient foam control agents in these laundry detergent formulations.

Examples of known enzymes which are effective in laundry detergent agents are protease, amylase and lipase. Preference is given to the enzymes which have their optimum performance at the design conditions of the washing and cleaning agent.

A large number of fluorescent whiteners are described in the literature. For laundry washing formulations, the derivatives of diaminostilbene disulfonates and substituted distyrylbifenyl are particularly suitable.

In addition to one or more of the aforementioned other surfactants and other detergent composition components, compositions according to the invention typically comprise one or more inert components. For instance, the balance of liquid detergent composition is typically an inert solvent or diluent, most commonly water. Powdered or granular detergent compositions typically contain quantities of inert filler or carrier materials.

The following examples illustrate certain particularly preferred embodiments of the present invention but are not intended to limit the invention's broader scope.

Examples 1–7

Examples 1–7 describe granular laundry detergent formulations containing IOS (internal olefin sulfonate) surfactants, and the performance characteristic of these formulations. The formulations of Examples 1, 3, 4, 6 and 7 are in accordance with this invention, while examples 2 and 5 are provided for comparative purposes.

| Component | Formulation No. (composition in % w) | | | | | | |
|---|---|---|---|---|---|---|---|
| | 1 | 2 | 3 | 4 | 5 | 6 | 7 |
| A $C_{16}$ IOS (having 75% by weight of beta-hydroxy alkane sulfonate) | — | — | 7.5 | — | — | — | — |
| B $C_{18}$ IOS (having 75% by weight of beta-hydroxy alkane sulfonate) | 15 | — | — | 7.5 | — | 7.5 | 7.5 |
| C $C_{18}$ IOS (conventional) | — | 15 | — | — | 7.5 | — | — |
| D DOBANOL 25-3 ® | — | — | 7.5 | 7.5 | 7.5 | — | — |
| E DOBANOL 45-7 | — | — | — | — | — | 7.5 | 7.5 |
| F $C_{12}$–$C_{22}$ fatty acid soap | 2 | 2 | 2 | 2 | 2 | 2 | 2 |
| G Zeolite A | 25 | 25 | 25 | 25 | 25 | — | — |
| H Sodium carbonate | 10 | 10 | 10 | 10 | 10 | 10 | — |
| I Tripolyphosphate | — | — | — | — | — | — | 25 |
| J Sodium silicate | 5 | 5 | 5 | 5 | 5 | 5 | 5 |
| K Sodium sulfate | 12 | 12 | 12 | 12 | 12 | 12 | 12 |

-continued

| Component | Formulation No. (composition in % w) 1 | 2 | 3 | 4 | 5 | 6 | 7 |
|---|---|---|---|---|---|---|---|
| L Water | balance | | | | | | |
| Detergency performance* | 70 | 66 | 73 | 75 | 74 | 68 | |

*Data given are % removal of sebum soil from permanent press polyester/cotton, in standard laboratory Terg-O-Tometer tests, under wash conditions: 40 deg C. wash water temperature, 20 min washing time, 300 water hardness (expressed as ppm $CaCO_3$) in the wash water; 5 g of detergent formulation per liter of wash water.

Examples 8–15

Examples 8–15 describe liquid laundry detergents according to the invention, including the results of performance evaluations in comparison to related formulations outside of the scope of the invention. The formulations of examples 8, 11 and 14 are in accordance with the invention.

| Component | Formulation No. (composition in % w) 8 | 9 | 10 | 11 | 12 | 13 | 14 | 15 |
|---|---|---|---|---|---|---|---|---|
| A $C_{16}$ IOS (having 75% by weight of beta-hydroxy alkane sulfonate) | 16 | — | — | 16 | — | — | 20 | — |
| B $C_{16}$ IOS (conventional) | — | 16 | — | — | 16 | — | — | 20 |
| C $C_{11}$–$C_{13}$ linear alkylbenzene sulfonates | — | — | 16 | — | — | 16 | — | — |
| D DOBANOL 25-7 | 16 | 16 | 16 | — | — | — | 10 | 10 |
| E DOBANOL 25-9 | — | — | — | 16 | 16 | 16 | — | — |
| F $C_{12}$–$C_{18}$ fatty acid soap | — | — | — | 8 | 8 | 8 | — | — |
| G Triethanol amine | — | — | — | 5 | — | — | — | — |
| H Potassium chloride | — | — | — | 1 | — | — | — | — |
| I Monopropylene glycol | — | — | — | 4 | — | — | — | — |
| J Enzymes, Optical brighteners | — | — | — | 2 | — | — | — | — |
| K Water | balance | | | | | | | |
| ph value | — | — | — | 9.0 | — | — | — | — |
| Detergency performance* | 62 | 60 | 49 | 63 | 54 | 59 | 58 | 42 |

*Data given are % removal of sebum soil from permanent press polyester/cotton, in standard laboratory Terg-O-Tometer tests, under wash conditions: 40 deg C. wash water temperature, 20 min washing time, 300 water hardness (expressed as ppm $CaCO_3$) in the wash water; 5 g of detergent formulation per liter of wash water.

Examples 16–22

Examples 16–22 describe formulations of IOS in several different liquid dishwashing detergent formulations, and the results of performance evaluation of the formulations.

| Component | Formulation No. (composition in % w) 16 | 17 | 18 | 19 | 20 | 21 | 22 |
|---|---|---|---|---|---|---|---|
| A $C_{16}$ IOS (having 75% by weight of beta-hydroxy alkane sulfonate) | — | — | 32 | — | — | — | — |
| B $C_{16}/C_{18}$ IOS | 40 | — | — | 32 | — | 25.6 | 28.8 |
| C $C_{11}$–$C_{13}$ linear alkylbenzene sulfonates | — | 40 | — | — | 32 | — | — |
| D DOBANOL 25-3S | — | — | 8 | 8 | 8 | 6.4 | 7.2 |
| E DOBANOL 91-9 | — | — | — | — | — | 8 | 4 |
| F Amidobetaine | — | — | — | — | — | — | 4 |
| G Sodium xylene sulfonate | 2 | 2 | 2 | — | — | — | — |
| H Urea | 2 | 2 | 2 | 2 | 2 | 2 | 2 |
| I Ethanol | 8 | 8 | 4 | 4 | 4 | — | 4 |
| J Water | balance | | | | | | |
| Dishwashing performance* | | | | | | | |
| soft water | 118 | 66 | 69 | 126 | 98 | — | — |
| hard water | 117 | 72 | 99 | 130 | 96 | — | — |

*Standard foam titration tests were carried out at 40° C. using as a representative soil a mixture of olive oil, cooking fat and mashed potato powder. The detergent formulation was applied at a concentration (based on surfactant) of 0.29 grams per liter (g/l). Performance data are expressed as percentages relative to a standard formulation based on alkylbenzene sulfonate and alkylpolyglycolsulfate.

Examples 23–26

Examples 23–26 describe a number of different detergent formulations containing IOS surfactant, in accordance with the invention. Example 23 represents a general purpose cleaning agent, example 24 a liquid soap formulation, example 25 a shampoo, and example 26 a liquid scouring agent.

| Component | Formulation No. (composition in % w) 23 | 24 | 25 | 26 |
|---|---|---|---|---|
| A $C_{16}$ IOS (having 75% by weight of beta-hydroxy alkane sulfonate) | 6 | 10 | 8 | 3 |
| B DOBANOL 91-6 | 2 | — | — | 1 |
| C DOBANOL 25-3S | — | 5 | 8 | — |
| D Lauric acid diethanolamide | — | 5 | 2 | — |
| E $C_{12}$–$C_{14}$ alkyldimethylbetaine | — | — | 2 | — |
| F Potassium pyrophosphate | 4 | — | — | 4 |
| G Monoethanol amine | — | — | — | 1 |
| H Glycerol | — | 4 | — | — |
| I Sodium chloride | — | 4 | — | 1 |
| J Calcium carbonate | — | — | — | 36 |

We claim as our invention:

1. A detergent composition comprising an internal olefin sulfonate salt, having from 8 to 26 carbon atoms, wherein at least about 25 percent by weight of the total amount of the internal olefin sulfonate is in the beta-hydroxy alkane sulfonate form.

2. The detergent composition of claim 1, wherein the internal olefin sulfonate salt is a salt of an alkali metal, alkaline earth metal, ammonium or organic base.

3. The detergent composition according to claim 2, wherein from about 50 to about 90 by weight of the internal olefin sulfonate is in the beta-hydroxy alkane sulfonate form.

4. The detergent composition of claim 3, wherein from about 60 to about 85 percent by weight of the internal olefin sulfonate is in the beta-hydroxy alkane sulfonate form.

5. The detergent composition of claim 2, wherein wherein the internal olefin sulfonate contains from 12 to 20 carbon atoms.

6. The detergent composition of claim 3, wherein the internal olefin sulfonate contains from 12 to 20 carbon atoms.

7. The detergent composition of claim 3, wherein the internal olefin sulfonate contains from 12 to 20 carbon atoms.

8. The detergent composition of claim 7, wherein the internal olefin sulfonate salt is a salt of sodium, potassium, ammonium or an organic base.

9. The detergent composition of claim 8, comprising at least one anionic surfactant selected from the group consisting of alkylbenzene sulfonates, alkane sulfonates, alpha-olefin sulfonates, ester sulfonates, primary and secondary alkyl sulfates, alkylpolyether sulfates and alkyl polyether carboxylates.

10. The detergent of claim 8, comprising at least one nonionic surfactant selected from the group consisting of alcoholethoxylates, alkylphenolethoxylates, polyethylene glycol esters, alkyl polysaccharides and fatty acid mono- and dialkanolamides.

11. The detergent composition of claim 8, comprising at least one anionic surfactant selected from the group consisting of alkyl sulfonates and alkyl sulfates, having from 8 to 18 carbon atoms; alkyl polyether sulfates and alkyl polyether carboxylates, having 10 to 18 carbon atoms in the alkyl group and from 1 to 5 ethoxy groups; alkylbenzene sulfonates, having from 8 to 18 carbon atoms in the alkyl chain; alpha-olefin sulfonates prepared by sulfonation of $C_{12}$–$C_{24}$ alpha-olefins; and sulfonated methyl ester of fatty acids.

12. The detergent composition of claim 8, which additionally comprises the condensation product of an average of 1 to 12 mol ethylene oxide with one mol of fatty alcohol, oxo-alcohol a secondary alcohol having 8 to 18 carbon atoms or with one mol of mono- or dialkylphenol having 6 to 12 carbon atoms in the one or two alkyl chains.

13. The detergent composition according to claim 8, additionally comprising at least one nonionic surfactant which is selected from the group consisting of polyethylene glycol esters based on $C_{10}$–$C_{18}$ fatty acids with an average of 2 to 12 ethoxy groups per molecule; the condensation products of detergent range alcohols with ethylene oxide and propylene oxide, in which the average number of ethoxy groups ranges from 3 to 12 per molecule and the average ratio of ethoxy/propoxy groups is from 4 to 12; and alcohol ethoxylates in which the hydrogen of the hydroxyl group is replaced by an alkyl group having 1 to 4 carbon atoms or acetyl group.

* * * * *